United States Patent [19]

Saintsing

[11] Patent Number: 5,076,295

[45] Date of Patent: Dec. 31, 1991

[54] CIGARETTE FILTER

[75] Inventor: Barry L. Saintsing, Lexington, N.C.

[73] Assignee: R. J. Reynolds Tobacco Company, Winston-Salem, N.C.

[21] Appl. No.: 414,835

[22] Filed: Sep. 29, 1989

[51] Int. Cl.[5] ..... A24D 3/00

[52] U.S. Cl. ..... 131/332; 131/335

[58] Field of Search ..... 131/331, 332, 335

[56] References Cited

U.S. PATENT DOCUMENTS

| | | | |
|---|---|---|---|
| 2,001,709 | 5/1935 | Davidson . | |
| 2,202,839 | 6/1940 | Davidson . | |
| 2,948,282 | 8/1960 | White . | |
| 3,110,315 | 11/1963 | Lenduai | 131/331 |
| 3,144,024 | 8/1964 | Eichwald et al. . | |
| 3,219,041 | 11/1965 | Bromberg . | |
| 3,313,305 | 4/1967 | Noznick et al. . | |
| 3,319,630 | 5/1967 | Orrmins . | |
| 3,353,543 | 11/1967 | Sproull et al. . | |
| 3,368,566 | 2/1968 | Avedikian . | |
| 3,516,417 | 6/1970 | Moses . | |
| 3,584,630 | 6/1971 | Inskeep . | |
| 3,589,371 | 6/1971 | Laporte . | |
| 3,603,319 | 9/1971 | Badgett et al. . | |
| 3,768,489 | 10/1973 | Kiefer et al. . | |
| 3,849,241 | 11/1974 | Butin et al. . | |
| 4,173,504 | 11/1979 | Tomioka et al. . | |
| 4,188,960 | 2/1980 | Morie et al. . | |
| 4,273,600 | 6/1981 | Luke . | |
| 4,318,417 | 3/1982 | Hiroshi et al. . | |
| 4,355,995 | 10/1982 | Berger . | |
| 4,492,240 | 1/1985 | Hayes et al. . | |
| 4,546,040 | 10/1985 | Knotek et al. . | |
| 4,700,723 | 10/1987 | Yoshikawa et al. . | |
| 4,763,674 | 8/1988 | Lelah . | |
| 4,793,365 | 12/1988 | Sensabaugh et al. . | |
| 4,800,903 | 1/1989 | Ray et al. . | |
| 4,807,809 | 2/1989 | Pryor et al. . | |
| 4,811,745 | 3/1989 | Cohen et al. . | |
| 4,858,629 | 8/1989 | Cundari . | |
| 4,889,143 | 12/1989 | Pryor et al. . | |
| 4,971,078 | 11/1990 | Deutsch et al. . | |

FOREIGN PATENT DOCUMENTS

| | | |
|---|---|---|
| 0250806 | 1/1988 | European Pat. Off. . |
| 0304759 | 3/1989 | European Pat. Off. . |
| 0330709 | 9/1989 | European Pat. Off. . |
| 2170391 | 8/1986 | United Kingdom . |
| 2201879 | 9/1988 | United Kingdom . |

*Primary Examiner*—V. Millin

[57] ABSTRACT

A cigarette comprises a blend of tobacco materials and a filter element provided from a non-woven polypropylene web, glycerin and a water soluble tobacco extract. The filter element comprises about 5 to about 55 percent tobacco extract, based on the total weight of the filter material and tobacco extract.

18 Claims, 1 Drawing Sheet

CIGARETTE FILTER

BACKGROUND OF THE INVENTION

The present invention relates to smoking articles such as cigarettes, and in particular to filter elements for cigarettes.

Popular smoking articles, such as cigarettes, have a substantially cylindrical rod shaped structure and include a charge of smokable material such as shredded tobacco (e.g., cut filler) surrounded by a paper wrapper, thereby forming a so-called "tobacco rod." It has become desirable to manufacture a cigarettes having a cylindrical filter element aligned in an end-to-end relationship with the tobacco rod. Typically, a filter element includes cellulose acetate tow circumscribed by plug wrap, and is attached to the tobacco rod using a circumscribing tipping material.

It would be desirable to provide a cigarette which provides flavorful mainstream smoke.

SUMMARY OF THE INVENTION

The present invention relates to smoking articles, such as cigarettes. Smoking articles of the present invention include a filter element which includes a rod shaped segment of a gathered web of non-woven thermoplastic fibers which is in intimate contact with a water soluble tobacco extract. Such a segment is referred to as an "extract-containing filter segment." The filter element may include only an extract-containing filter segment, or such a segment can be combined with at least one other filter segment.

Smoking articles of the present invention (i.e., which have extract-containing filter segments incorporated therein) can have various forms. Preferred smoking articles are rod shaped. For example, the smoking article can have the form of a cigarette having a tobacco-containing smokable material wrapped in a circumscribing paper wrapping material. Other suitable smoking articles are described in U.S. Pat. Nos. 4,771,795 to White et al; 4,714,082 to Banerjee et al; 4,756,318 to Clearman et al; 4,793,365 to Sensabaugh et al and 4,827,950 to Banerjee et al; and European Patent Application Nos. 212,234; 277,519; 280,990 and 305,788.

DETAILED DESCRIPTION OF THE PREFERRED EMBODIMENTS

Figure 1:
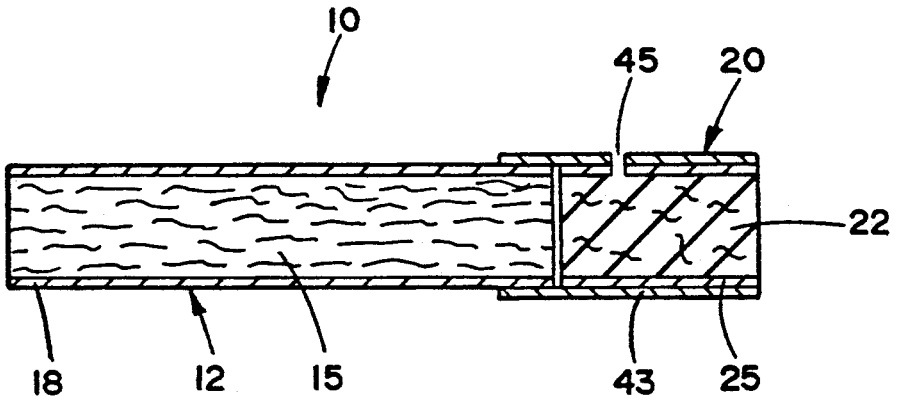
FIGS. 1 and 2 are longitudinal, sectional views of rod-shaped smoking articles representative of the present invention.
Figure 2:
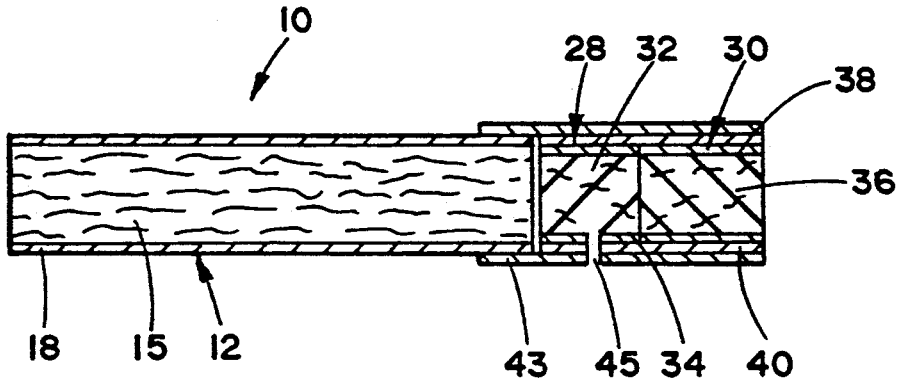

Representative embodiments of the present invention shown in FIGS. 1 and 2. Cigarette 10 includes a generally cylindrical rod 12 of a charge or roll of smokable filler material 15 contained in circumscribing wrapping material 18. The rod 12 is conveniently referred to as a "smokable rod" or a "tobacco rod." The ends of the tobacco rod are open to expose the smokable filler material.

Typically, the tobacco rod 12 has a length which ranges from about 50 mm to about 85 mm, and a circumference of about 16 mm to about 28 mm. The tobacco rods and the resulting cigarettes can be manufactured in any known configuration using known cigarette making techniques and equipment.

Referring to FIG. 1, cigarette 10 normally includes a filter element 20 positioned adjacent one end of the tobacco rod 12 such that the filter element and tobacco rod are axially aligned in an end-to-end relationship, preferably abutting one another. Filter element 20 has a generally cylindrical shape, and the diameter thereof is essentially equal to the diameter of the tobacco rod. The ends of the filter element are open to permit the passage of air and smoke therethrough. The filter element 20 includes filter material 22 which is overwrapped along the longitudinally extending surface thereof with circumscribing plug wrap material 25.

Typically, the filter element 20 has a length which ranges from about 20 mm to about 35 mm and a circumference of about 16 mm to about 28 mm.

The plug wrap 25 typically is a conventional paper plug wrap, and can be either air permeable or essentially air impermeable.

Filter element 20 includes a filter material 22 having the form of a gathered web of non-woven thermoplastic (i.e., hydrophobic) fibers which is in intimate contact with a water soluble tobacco extract so as to provide an extract-containing filter material. A highly preferred web of thermoplastic fibers is a non-woven web of polypropylene fibers available as PP manufactured by a melt blowing process as is described in U.S. Pat. No. 3,849,241 to Buntin et al. Water soluble tobacco extracts are provided by extracting a tobacco material with a solvent having an aqueous character (i.e., a solvent consisting primarily of water, preferably greater than 90 weight percent water, and most preferably essentially pure water). The specific composition of the tobacco extract can vary, depending upon factors such as the type of tobacco material which is extracted and the type of extraction conditions. Extract-containing filter materials also include a minor amount of a lubricating substance, such as a polyhydric alcohol (e.g., glycerin, propylene glycol, or the like). The lubricating substance provides flexibility to the web, and provides a web which can be shaped without the application of heat. Typical extract-containing filter materials include about 5 to about 55, preferably about 10 to about 30, weight percent tobacco extract, and up to about 10 percent lubricating substance, based on the total weight of the extract-containing filter material. Typical extract-containing filter materials are manufactured by providing an aqueous mixture of extract and lubricating substance, applying the liquid to a web of non-woven thermoplastic fibers using a rotogravure process, and drying the web. If desired, the tobacco extract can be a spray dried extract, a freeze dried extract or a tobacco essence, and in turn dissolved in water. Methods for preparing and processing tobacco extracts are set forth in U.S. Pat. application Ser. No. 262,770, filed Oct. 26, 1988, now Pat. No. 5,005,593 which is incorporated herein by reference. Typically, the tobacco extract contained within the web has a moisture content of about 5 to about 6 weight percent, although the moisture content of a particular tobacco extract can vary.

Referring to FIG. 2, cigarette 10 includes a filter element 20 having a first filter segment 28 and second filter segment 30. The first filter segment 28 is positioned adjacent one end of the tobacco rod 12, and the second filter segment is positioned adjacent one end of the first filter segment. The first filter segment 28 includes a first filter material 32 which is overwrapped along the longitudinally extending surface thereof with a circumscribing plug wrap material 34. The second filter segment 30 includes a second filter material 36 which is similarly overwrapped with a plug wrap material 38. The filter segments 28, 30 are axially aligned in an end-to-end relationship, preferably abutting one another; and are maintained in place by circumscribing outer plug wrap material 40. The inner surface of the outer plug wrap 40 is fixedly secured to the outer surfaces of the plug wraps of respective filter segments 28 and 30. The filter segments can be provided in the desired alignment using plug tube combination machinery which is familiar to the skilled artisan.

Normally, the first filter segment 28 includes filter material 32 which has the form of the previously described extract-containing filter material. The second filter segment 30 normally includes filter material 36 which has the form of cellulose acetate tow, polypropylene tow, gathered non-woven polypropylene web, or the like. The second segment can be a nonwrapped cellulose acetate filter element, if desired. Flavors and other smoke modifying agents can be incorporated into the second filter segment, if desired. Various second segments can be provided from filter rods which are manufactured using known techniques and machinery.

Referring again to both of FIGS. 1 and 2, filter element 20 is attached to the tobacco rod 12 by tipping material 43 which circumscribes both the entire length of the filter element and an adjacent region of the tobacco rod. The inner surface of the tipping material 43 is fixedly secured to the outer surface of the filter element 20 and the outer surface of the wrapping material 18 of the tobacco rod, using a suitable adhesive. A preferred ventilated or air diluted cigarette is provided with an air dilution means such as a series of perforations 45 each of which extend through the tipping material and plug wrap.

The smokable materials useful herein can vary. Examples of highly preferred smokable materials are the tobacco materials which include flue-cured, Oriental, Maryland and Burley tobaccos, as well as the rare and specialty tobaccos. Generally, the tobacco material has been aged. The tobacco material can be in the form of tobacco laminae, processed tobacco stems, reconstituted tobacco material, volume expanded tobacco filler, or blends thereof. The type of reconstituted tobacco material can vary (i.e., the reconstituted tobacco material can be manufactured using a variety of reconstitution processes). Blends of the aforementioned materials and tobacco types can be employed.

The smokable materials generally are employed in the form of cut filler as is common in conventional cigarette manufacture. For example, the smokable filler material can be employed in the form of shreds or strands cut into widths ranging from about 1/5 inch to about 1/60 inch, preferably from about 1/30 inch to about 1/40 inch. Generally, such pieces have lengths which range from about 0.25 inch to about 3 inches.

The filler materials can be employed with or without casing or top dressing additives. See, for example, Leffingwell et al, *Tobacco Flavoring for Smoking Products* (1972). Flavorants such as menthol can be incorporated into the cigarette using techniques familiar to the skilled artisan. If desired, flavor additives such as organic acids can be incorporated into the cigarette as additives to the cut filler. For example, the levulinic acid, nicotine levulinate or levulinic acid/nicotine mixture can be added to the cut filler in amounts which typically range from about 0.5 to about 10 percent, based on the weight of the cut filler. See, U.S Pat. No. 4,830,028 to Lawson et al.

The wrapping material which circumscribes the charge of smokable filler can vary. Examples of suitable wrapping materials are cigarette paper wrappers available as Ref. No. 719, 754, 756, 854 and 856 from Kimberly-Clark Corp. As suitable are cigarette paper wrappers available as P-2123-101, P-2123-102, P-2123-104, P-2123-106, P-2123-107, P-2123-108, P-2123-109, P-2123-111, P-2123-112, P-2123-114, from Kimberly-Clark Corp.; and cigarette paper wrappers available as TOD 01788, TOD 03363, TOD 03732, TOD 03957, TOD 03949, TOD 03950, TOD 03953, TOD 03954, TOD 04706, TOD 04742 and TOD 04708 from Ecusta Corp. Preferred paper wrappers have low inherent air permeabilities (e.g., permeabilities of less than about 15 CORESTA units). A particularly preferred paper wrapper is a low permeability, high basis weight paper having a high surface area calcium carbonate filler and a relatively high application of potassium succinate burn additive. Such a paper is available as P-2123-114 from Kimberly-Clark Corp. Another particularly preferred paper wrapper (i) has a low inherent permeability, high basis weight paper having a calcium carbonate and magnesium hydroxide filler, and a potassium acetate burn chemical, and (ii) has been electrostatically perforated so as to have a relatively high net permeability (e.g., a net permeability of greater than 50 CORESTA units). Such papers are available as TOD 03732 and TOD 04742 from Ecusta Corp.

Typically, the tipping material circumscribes the filter element and an adjacent region of the smokable rod such that the tipping material extends about 3 mm to about 6 mm along the length of the smokable rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents, thereby providing a means for providing air dilution to the cigarette. The total surface area of the perforations and the positioning of the perforations along the periphery of the cigarette can be varied in order to control the performance characteristics of the cigarette.

Preferably, the air dilution means is positioned along the length of the cigarette at a point along the filter which is at a maximum distance from the extreme mouthend thereof. The maximum distance is dictated by factors such as manufacturing constraints associated with the type of typing employed and the cigarette manufacturing apparatus and process. For example, for a filter element having a 27 mm length, the maximum distance may range from about 23 mm to about 26 mm from the extreme mouthend of the filter element. The positioning of the air dilution vents a maximum distance from the extreme mouthend of the article allows for providing a maximum ventilation level for a given "tar" yield and maximum cigarette pressure drop for a given filter element and smokable rod combination.

As used herein, the term "air dilution" is the ratio (generally expressed as a percentage) of the volume of air drawn through the air dilution means to the total volume of air and smoke drawn through the cigarette and exiting the extreme mouthend portion of the cigarette. For air diluted or ventilated cigarettes of this invention, the amount of air dilution can vary. Generally, the amount of air dilution for a cigarette is greater than about 30 percent, preferably greater than about 40 percent, more preferably greater than about 50 percent. Typically, for cigarettes of relatively small circumference (i.e., about 21 mm or less) the air dilution can be somewhat less than that of cigarettes of larger circumference. The upper limit of air dilution for a cigarette typically is less than about 85 percent, more frequently less than about 75 percent.

Cigarettes of the present invention exhibit a desirably high resistance to draw. For example, cigarettes of this invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of this invention preferably exhibit resistance to draw values of about 70 to about 180, more preferably about 80 to about 150 mm water pressure drop at 17.5 cc/sec. air flow.

The following example is provided in order to further illustrate various embodiments of the invention but should not be construed as limiting the scope thereof. Unless otherwise noted, all parts and percentages are by weight.

EXAMPLE 1

Cigarettes substantially as shown in FIG. 2 are prepared as follows:

The cigarettes have a length of 99 mm and a circumference of 24.8 mm, and include a smokable rod having a length of 68 mm and a filter element having a length of 31 mm. Each smokable rod comprises a blend of smokable material circumscribed by a single layer of paper wrapper. The packing density of the smokable material within each smokable rod is 196 mg/cm$^3$. Each filter element includes two segments. The first segment is an extract-containing filter segment circumscribed by non-porous paper plug wrap. The first filter segment is positioned adjacent the smokable rod. The second segment includes cellulose acetate tow (8 denier per filament, 40,000 total denier) circumscribed by non-porous paper plug wrap. The second filter segment has a length of 16 mm, and is positioned adjacent the first filter segment. The first and second segments are circumscribed by non-porous plug wrap, to hold the segments in place and hence form a filter element. Each filter element is attached to each tobacco rod using non-porous tipping paper. For each cigarette, the tipping paper circumscribes the filter element and a 4 mm length of the tobacco rod in the region adjacent the filter element.

The first filter segment has a length of 15 mm. The segment is provided by gathering or pleating a web of non-woven polypropylene using the rod forming apparatus described in Example 1 of U.S. Pat. No. 4,807,809 to Pryor et al., which is incorporated herein by reference. The web has a width of 11.75 inches, a basis weight of about 0.7 oz/yd$^2$, and is available as PP200SD from Kimberly-Clark Corp. The web so described has applied thereto a water soluble tobacco extract and glycerin. The extract and glycerin are applied to the web using a rotogravure process. In particular, a spray dried aqueous Burley tobacco extract and glycerin are dissolved in water, applied to the web using a rotogravure process, and the resulting wet web is dried to provide a tobacco extract and glycerin in intimate contact with the non-woven polypropylene web. The resulting web comprises about 70 percent polypropylene, about 28 percent tobacco extract and about 2 percent glycerin.

The previously described spray dried extract is provided as follows:

Aged Burley tobacco is ground to a dust and extracted with water in a stainless steel tank at a concentration of about1 to about 1.5 pounds tobacco per gallon of water. The extraction is conducted at ambient temperature over a period of about 1 to about 3 hours, while the slurry of tobacco in water is mechanically agitated. The slurry then is centrifuged to remove suspended solids. The aqueous tobacco extract is concentrated in a thin film evaporator to a concentration of about 30 percent dissolved tobacco solids. The concentrated aqueous extract then is spray dried by continuously pumping the aqueous extract to an Anhydro Size No. 1 Spray Dryer. The dried powder is collected at the outlet of the spray dryer. The inlet temperature of the spray dryer is about 215° C., and the outlet temperature is about 82° C. The spray dried powdered extract has a moisture content of about 6 to about 8 percent.

The paper wrapper of the smokable rod comprises about 60 percent flax, about 25 percent magnesium hydroxide and about 15 percent calcium carbonate, to which is incorporated a potassium acetate burn additive. The paper has an inherent permeability of 10 CORESTA units and has been electrostatically perforated to have a net permeability of 110 CORESTA units. The paper wrapper is available as Ecusta Experimental Paper No. TOD 03722 from Ecusta Corp.

The smokable material is a blend of 50 percent volume expanded flue-cured tobacco laminae, 33 percent reconstituted tobacco, 10.2 percent Maryland tobacco laminae and 6.8 percent Oriental tobacco laminae. The smokable material is in the form of laminae cut into strands at 32 cuts per inch. The volume expanded tobacco is tobacco laminae which is cut into cut filler form and which has been expanded to about twice its original volume using a process as described generally in U.S. Pat. No. 3,524,451 to Fredrickson.

The reconstituted tobacco is provided using a papermaking process using a starting blend of 80 percent flue-cured tobacco laminae, 12 percent Maryland tobacco laminae and 8 percent Oriental tobacco laminae. The reconstituted tobacco includes 44 percent extracted tobacco, 20 percent tobacco extract and 36 percent calcium carbonate. The calcium carbonate is ground limestone available as 15M Grade from Georgia Marble Co. All of the extract (i.e., dissolved tobacco solids) which is extracted from the starting tobacco blend is employed to provide the reconstituted tobacco material (i.e., all of the tobacco extract is applied back to the extracted tobacco during the reconstitution process).

The blend of smokable materials is provided so as to have total moisture content of about 7 percent (i.e., such that the tobacco material within the blend has a moisture content of about 12 percent).

The cigarettes are employed by burning the smokable rod such that the blend of smokable material within the paper wrapper burns to yield smoke. When employed, such cigarettes yield very low levels of visible sidestream smoke.

The resulting cigarette provides good tobacco flavor, and yields about 12 mg FTC "tar."

EXAMPLE 2

A filter segment having a length of 10 mm and having the form of an extract-containing filter segment is provided as set forth in Example 1. The filter segment so provided is used to replace the tobacco-paper filter in the cigarette described in *Chemical and Biological Studies on New Cigarette Prototypes That Heat Instead of Burn Tobacco,* R. J. Reynolds Tobacco Co., (1988).

EXAMPLE 3

A filter segment as described in Example 2 is used to replace the gathered tobacco paper segment of the cigarette described in Example 1 of U.S. Pat. application Ser. No. 378,551, filed July 11, 1989now Pat. No. 4,991,596.

What is claimed is:

1. A cigarette having a charge of smokable material to be burdened to yield smoke wrapped in a circumscribing paper wrapping material so as to provide a smokable rod having open ends to expose the smokable material; and the cigarette comprising a filter element positioned adjacent one end of the smokable rod, the filter element including a gathered web of non-woven thermoplastic fibers in intimate contact with a water soluble tobacco extract prior to smoking; the web comprising bout 5 to about 55 percent tobacco extract, based on the total weight thereof.

2. The cigarette of claim 1 wherein the thermoplastic fibers are polypropylene fibers.

3. The cigarette of claim 1 or 2 wherein the web is in intimate contact with a polyhydric alcohol.

4. The cigarette of claim 1 or 2 wherein the web comprises about 5 to about 55 percent tobacco extract, and up to about 10 percent polyhydric alcohol, based on the total weight thereof.

5. The cigarette of claim 1 or 2 wherein tobacco extract has a moisture constant of about 5 to about 6 weight percent.

6. The cigarette of claim 1 wherein the web of non-woven thermoplastic fibers is provided using a melt blowing process.

7. The cigarette of claim 1 or 2 wherein the web comprises about 10 to about 30 percent tobacco extract, based on the total weight thereof.

8. The cigarette of claim 7 comprising at least one other filter element.

9. The cigarette of claim 1 or 2 comprising at least one other filter element.

10. A smoking article comprising a filter element which includes a gathered web of non-woven thermoplastic fibers in intimate contact with a water soluble tobacco extract prior to smoking; the web comprising about b 5 to about 55 percent tobacco extract, based on the total weight thereof.

11. The smoking article of claim 10 wherein the thermoplastic fibers are polypropylene fibers.

12. The smoking article of claim 10 or 11 wherein the web is in intimate contact with a polyhydric alcohol.

13. The smoking article of claim 10 or 11 wherein the web comprises about 5 to about 55 percent tobacco extract, and up to about 10 percent polyhydric alcohol, based on the total weight of the web.

14. The smoking article of claim 10 or 11 wherein the tobacco extract has a moisture content of about 5 to about 6 weight percent.

15. The smoking aticle of claim 10 wherein the web of non-woven thermoplastic fibers is provided using a melt blowing process.

16. The smoking article of claim 10 or 11 wherein the web comprises about 10 to about 30 percent tobacco extract, based on the total weight whereof.

17. The cigarette of claim 16 comprising at least one other filter element.

18. The cigarette of claim 10 or 11 comprising at least one other filter element.

* * * * *